United States Patent [19]

Haywood et al.

[11] 4,096,056

[45] Jun. 20, 1978

[54] METHOD OF PRODUCING AN IMPREGNATING PETROLEUM PITCH

[75] Inventors: Samuel Isa Haywood, Bakersfield, Calif.; John Howard Semon, Barnegat, N.J.

[73] Assignee: Witco Chemical Corporation, New York, N.Y.

[21] Appl. No.: 734,497

[22] Filed: Oct. 21, 1976

[51] Int. Cl.[2] ..... C10C 3/04

[52] U.S. Cl. ..... 208/4; 208/22; 208/39; 208/44; 208/6

[58] Field of Search ..... 208/4, 6, 39, 22

[56] References Cited

U.S. PATENT DOCUMENTS

| | | | |
|---|---|---|---|
| 2,762,756 | 9/1956 | Kinnaird | 208/4 |
| 2,991,241 | 7/1961 | Renner | 208/4 |
| 3,317,622 | 5/1967 | Hoertz, Jr. et al. | 208/4 |
| 3,350,295 | 10/1967 | Hamner et al. | 208/4 |
| 3,725,240 | 4/1973 | Baum | 208/4 |
| 3,856,657 | 12/1974 | Seinfeld | 208/6 |
| 4,013,540 | 3/1977 | Moyle et al. | 208/4 |

*Primary Examiner*—Veronica O'Keefe
*Attorney, Agent, or Firm*—Albert L. Gazzola; Morton Friedman

[57] ABSTRACT

A method for producing an impregnating petroleum pitch in two steps. In the first step, aromatic oils undergo polymerization with a controlled feed of an oxygen-containing gas at a temperature of less than 700° F to a softening point of from about 30° to about 100° C, and in a second step, the pitch is stripped under controlled conditions in an inert environment to a softening point of between 100°-135° C. This low temperature with controlled stripping permits the formation of an impregnating pitch having a beta resin content of less than about 15% with a low quinoline insolubles content, and a Conradson Carbon of about 50%.

Benzene Insolubles, as herein disclosed, are determined by ASTM D-2317; Quinoline Insolubles are determined by ASTM D-2318; Conradson Carbon is determined by ASTM D-189; and Softening Point by ASTM D-3104.

6 Claims, No Drawings

METHOD OF PRODUCING AN IMPREGNATING PETROLEUM PITCH

This invention relates to the manufacture of petroleum pitch for impregnating porous molded carbon products.

Petroleum pitches for impregnating porous molded carbon articles for use as graphite, for instance, should be, in addition to being highly impregnating, of uniform consistency and quality, and should be substantially free from foreign materials such as ash, carbon particles, and the like. Such a pitch is produced by the present novel process.

Before this invention was made, there was not available a simple economical procedure for the manufacture of impregnating pitches.

In Baum, U.S. Pat. No. 3,725,240, issued in April 1973, there is disclosed a process for preparing petroleum pitch by oxidation polymerization in which a high boiling fraction from the bottoms of catalytically cracked petroleum gas oil is blown with air at the rate of from about 6 to about 30 standard cubic feet of air per barrel of liquid, at a temperature from about 750° F to about 850° F, and for a period not exceeding one hour, at pressures preferably up to 15 p.s.i.g.

In Kinnaird, Jr., U.S. Pat. No. 2,762,756, issued in September 1956, there is disclosed a method for producing asphalt which provides for charging a feedstock through an ejector into which air, as the oxidizing gas, is inducted by the charge. An inert gas such as nitrogen is fed into the oxidizing atmosphere for safety purposes.

While such prior art oxidation polymerization processes produced impregnating petroleum pitches, the methods employed require higher temperatures, pressures, and expensive equipment. The present process, unexpectedly yields an impregnating pitch using low temperatures and simple equipment in two steps. It can be accomplished in batchwise or continuous equipment, as known in the art.

The process of this invention comprises the controlled passing an oxygen-containing gas at a low feed rate through an aromatic hydrocarbon feedstock at relatively low temperatures of up to about 700° F, preferably 640°-680° F, and substantially atmospheric pressure, to achieve an intermediate pitch having a softening point of from about 30° C to about 100° C, and preferably between about 50° and 80° C, and thereafter a controlled stripping of the intermediate pitch at similar temperatures, to arrive at a pitch having an increased softening point, i.e. to about 100°-135° C. The pitch, at this softening point has a beta resin content of less than about 15%, and preferably about 10%, a low quinoline insolubles of less than 1%, and preferably less than 0.5%, and a Conradson Carbon of about 50%. The beta resin content of the pitch is the difference between the percent of benzene insolubles and quinoline insolubles. Thus, the beta resin content, because of the low quinoline insolubles, approaches that of the benzene insolubles of the impregnating pitch.

Stripping is preferably performed in an inert environment, such as with steam or vacuum, but most preferably with a flow of an inert gas such as nitrogen, at temperatures up to about 700° F. Preferably both the oxidation polymerization and the stripping are performed at temperatures of from about 640° to about 680° F.

Oxygen containing gases, as is well known in the art, include, for instance, oxygen, per se, peroxides, or more preferably air, which contains about 20% oxygen.

The oxygen feed rate of the oxidation polymerization step is generally from about 0.01 to 0.2 cu. ft. oxygen/min/bbl. (i.e. cubic feet of oxygen per minute per barrel), and preferably between 0.1-0.15 cu. ft. oxygen/min/bbl., for safety purposes. The inert gas flow of the stripping step is generally between 0.05 to about 2.0 cu. ft./min/bbl., and preferably from about 0.1 to about 1.3 cu. ft./min/bbl., for smooth operation. Increasing the flow of inert gas during the stripping step offers no additional advantage.

It is preferred to conduct both steps as fast as possible to arrive at the best possible products. The oxidation polymerization step, for instance, may be accomplished under the aforesaid conditions in less than one hour, and the stripping step may be accomplished under the aforesaid conditions in less than one hour as well, but depending on the size of the batch each step may require more than one hour.

Suitable feedstocks may be broadly characterized as aromatic petroleum fractions boiling above about 450° F and preferably in the range of 550°-1000° F. These feedstocks may be derived from steam or catalytic cracking of gas oils or mixtures of gas oils with heavy or light cycle stocks, clarified oils, from steam cracking of gas oils or naphthas, phenol extracts from relatively distillates, and the like.

Examples of feedstocks suitable for use in this invention include heavy virgin residual oil which form the bottoms fraction in the distillation of topped crude oil. The heavy virgin residual oils are obtained by delivering the topped crude oil from an atmospheric tower in which, for example, furnace oils and lighter fractions have been removed, to a vacuum tower. A distillate gas oil suitable for use as a catalytic cracking charge stock is discharged from the top of the vacuum tower and a bottoms fraction containing the heavy virgin residual oils is delivered from the bottom of the tower. These fractions include oils boiling above 1000° F.

A preferred suitable feedstock includes the bottoms fraction obtained from the distillation of cracked oil produced by the catalytic cracking of petroleum gas oils. Cracking is carried out in the presence of catalysts, such as silica-alumina catalysts, which are normally employed in the fluidized state. The cracked oil product is then distilled, the bottoms fraction being transferred to a slurry settler for catalyst recovery. The remaining oil is a suitable feedstock for the process of this invention.

Other petroleum fractions available from either thermal or catalytic cracking may be utilized as feeds to a steam cracker for production of suitable feedstock for this invention. The bottoms fraction of a fractionator of steam cracked products is a suitable feed for this process. This aromatic bottoms fraction includes those fractions boiling above 650° F.

In a preferred aspect of this invention, a clarified slurry oil is oxidized at temperatures of from about 640° F to about 680° F until the pitch softening point is from about 50° to about 80° C, and the pitch is then subjected to an inert gas flow for stripping while the temperature is maintained between 640° and 680° F until a final pitch product having a softening point from about 100° C to 135° C is attained. The product is an excellent penetrating pitch for penetrating porous carbon rods, as known in the art.

The following examples serve to illustrate the process of this invention and are not to be construed as limiting it in any way.

EXAMPLE 1

A clarified slurry oil is heated in a still and maintained at temperatures between 640° and 660° F while air is fed through at a rate of 0.05–1.0 cu. ft. oxygen/min/bbl. at atmospheric pressure. The air feed rate is adjusted depending on the amount of distillate being removed from the still. In about one hour, an intermediate pitch having a softening point of 76.4° C is achieved. Through the same oxygen feed sparger, inert gas in the form of nitrogen is introduced into the pitch material for stripping at a rate of 0.1 to 1.0 cu. ft./min/bbl. The inert gas rate is adjusted depending on the amount of distillate being removed. The temperature during stripping is maintained between 660° and 680° F. In about a half-hour, a pitch product is collected having a softening point of 117.3° C.

EXAMPLE 2

A decant oil was maintained between 640° and 670° F for oxidation polymerization as in Example 1 to a pitch having a softening point of 77.8° C. Nitrogen stripping yields a product having a softening point of 115.4° C.

EXAMPLE 3

A clarified slurry oil is maintained between 640° and 660° F as in Example 1. A product having a softening point of 77.4° C is obtained by the oxidation polymerization. Nitrogen stripping is then carried out at 670°–680° F to a pitch product having a softening point of 129.2° C.

EXAMPLE 4

A decant oil is heated to 660° F and maintained at that temperature during oxidation polymerization as in Example 1 until a pitch product having a softening point of 73.4° C is achieved. Stripping is accomplished with nitrogen at 650°–670° F to a pitch product having a softening point of 115.4° C.

EXAMPLE 5

A decant oil is heated to 640° F, using the procedure of Example 1, until a product having a softening point of 68.4° C is achieved by this oxidation. Using nitrogen stripping at 640°–670° F, the pitch material is stripped until a pitch product having a softening point of 114.2° C is reached.

The properties of the resultant pitch of Examples 1–5 are reported hereinafter in Table 1.

TABLE I

| Properties | Example 1 | Example 2 | Example 3 | Example 4 | Example 5 |
|---|---|---|---|---|---|
| Softening Point[a] | 117.3° C | 115.4° C | 129.2° C | 119.4° C | 114.2° C |
| Specific Gravity, 60° F/60° F | 1.25 | 1.25 | 1.25 | 1.25 | 1.25 |
| Modified Conradson Carbon[b] | 49.5% | 50.5% | 50.7% | 49.2% | 50.3% |
| Quinoline Insolubles[c] Weight Percent | 0.03% | 0.45% | 0.06% | 0% | 0.5% |
| Benzene Insolubles[d] Weight Percent | 12.5% | 13.1% | 9.6% | 14.1% | 15.5% |
| Beta Resin | 12.47% | 12.65% | 9.45% | 14.05% | 15.0% |

[a]ASTM D-3104
[b]ASTM D-189
[c]ASTM D-2318
[d]ASTM D-2317

As can be seen from the above examples, the beta resin content of the pitch product can be closely controlled to limits of from about 9% to 15%, with softening points of from about 100° to about 135° C.

The pitch products in the foregoing examples, which are substantially free of foreign matter, are used to impregnate porous carbon rods by immersing said rods in the hot impregnating pitch until saturated and then baking the impregnated rods. The calcined carbon rod products are successfully used to make graphite, as well known in the art.

While the above describes the preferred embodiments of the invention, it will be understood that departures may be made therefrom within the scope of the specification and claims.

We claim:

1. A two-step process for preparing an impregnating petroleum pitch having a Quinoline Insolubles of less than about 1% (ASTM D-2318), a beta resin content of less than about 15%, and Conradson Carbon of about 50% (ASTM D-189), consisting of:

(a) Passing an oxygen containing gas at a flow rate of 0.01 to about 0.2 cu. ft. oxygen/min/bbl. through an aromatic feedstock having a boiling point between 232° to 538° C, at a temperature of about 338° C to 360° C, to a pitch having a softening point of from about 30° to 100° C (ASTM D-3104), and;

(a) Stripping said pitch in an inert atmosphere to increase the softening point of said pitch to between 100° and 135° C (ASTM D-3104).

2. A process as in claim 1 wherein in step (a) air is used as the oxygen containing gas and wherein in step (b) nitrogen is passed through said hot pitch during the stripping process.

3. A process as in claim 2 wherein said nitrogen is passed through said hot pitch at a flow rate of from about 0.05 to 2.0 cu. ft./min/bbl.

4. A process as in claim 2 wherein the oxygen containing gas is air.

5. A process as in claim 2 wherein the air flow rate in step (a) is from about 0.1 to about 0.15 cu. ft. oxygen/min/bbl. and wherein in step (b) the nitrogen flow rate is from about 0.1 to 1.3 cu. ft./min/bbl.

6. The method of claim 2 wherein in step (a) the pitch product has a softening point of from about 50° to 80° C (ASTM D-3104).

* * * * *